US006607399B2

(12) United States Patent
Endo et al.

(10) Patent No.: US 6,607,399 B2
(45) Date of Patent: Aug. 19, 2003

(54) COAX CONNECTOR FOR PREVENTING THERMAL DEGRADATION OF TRANSMISSION CHARACTERISTICS

(75) Inventors: Takayoshi Endo, Shizuoka (JP); Kimihiro Abe, Shizuoka (JP); Kouji Tagashi, Tokyo (JP)

(73) Assignees: Yazaki Corporation, Tokyo (JP); SMK Corporation, Tokyo (JP)

( * ) Notice: Subject to any disclaimer, the term of this patent is extended or adjusted under 35 U.S.C. 154(b) by 0 days.

(21) Appl. No.: 10/159,980

(22) Filed: May 29, 2002

(65) Prior Publication Data

US 2002/0182934 A1 Dec. 5, 2002

(30) Foreign Application Priority Data

May 29, 2001 (JP) ..... 2001-160742

(51) Int. Cl.[7] ..... H01R 9/05
(52) U.S. Cl. ..... 439/578; 439/932
(58) Field of Search ..... 439/578, 585, 439/421, 932, 733.1

(56) References Cited

U.S. PATENT DOCUMENTS 3,541,495 A * 11/1970 Ellis et al. ..... 439/578
3,744,007 A * 7/1973 Horak ..... 439/394
5,230,640 A * 7/1993 Tardif ..... 439/578
5,820,408 A * 10/1998 Wang ..... 439/578
6,312,294 B1 * 11/2001 Lai ..... 439/733.1
6,482,033 B2 * 11/2002 Togashi et al. ..... 439/578

* cited by examiner

*Primary Examiner*—Tho D. Ta
(74) *Attorney, Agent, or Firm*—Darby & Darby

(57) ABSTRACT

A coaxial connector includes a central contact, an insulating housing, a grounding shell and a clamp. Central contact, a cylindrical slim member, is formed by stamping a conductive thin metal sheet of phosphor bronze or other specially suitable material. The central contact has a forward end portion slotted to form a pair of leaf-spring-like contact pieces enabling resilient contact with both sides of plug pin. Plug pin is inserted into a contact receiving hole from the front side to establish electrical connections with contact pieces. Rear end portion of the central contact is integrally formed with an open-topped crimp barrel that has a U-shaped cross section in a plane perpendicular to the lengthwise direction of the central contact. Crimp barrel serves as a conductor connecting portion that is crimped into contact with the central conductor of the coaxial cable once the central conductor is inserted into the central contact from rear end portion.

13 Claims, 9 Drawing Sheets

COAX CONNECTOR FOR PREVENTING THERMAL DEGRADATION OF TRANSMISSION CHARACTERISTICS

BACKGROUND OF THE INVENTION

1. Field of the Invention

The present invention relates to a coaxial connector that is connected to a coaxial cable at one end for external connection. More particularly, the coaxial connector is connected to a coaxial cable that is run in environments where the coaxial conncetor undergoes thermal shock and variation in temperature.

2. Description of the Prior Art

Referring now to FIG. 8, a conventional coaxial cable designed to carry high-frequency signal includes a central conductor 111. Central conductor 111 is coaxially layered with an insulated cable dielectric 112, a woven or braided outer conductor 113 and an insulating outer cladding 114 as shown. Referring now to FIG. 9, in a conventional design coaxial connector 100 is affixed to one end of the the coaxial cable and enables connection to other equipment or another coaxial cable.

Conventional coaxial connector 100 includes a central contact 101 formed by bending a conductive metal sheet. An insulating housing 103 surrounds a contact receiving hole 102 formed to receive the central contact 101. A cylindrical grounding shell 104 mounts on an outer surface of insulating housing 103.

Central contact 101 has a forward (to right-hand side in FIG. 9) portion formed as a plate-spring-like contact piece 108 and a rearward portion formed as a conductor clamping barrel 106, 108. to connect with central conductor 111. Contact receiving hole 102 extends through insulating housing 103 lengthwise and receives central conductor or switch for contact 101 during an assembly. Contact receiving hole 102 also guides a plug pin 120 of, a mating connector, into contact with contact piece 108.

Referring now to FIG. 10, an assembly sequence for connecting a coaxial cable to coaxial connector 100 is shown and described. First, a cylindrical clamp 107 is placed on coaxial cable, and then a grounding shell 104 is slid onto insulating housing 103 from behind to form a unitary structure. Next, central conductor 111 is inserted into clamping barrel 106. Central conductor 101 has a U-like cross section formed at rear end portion of central contact 101.

At same time central contact 101 is inserted into insulating housing 103, a shell connecting part 105, that extends rearwardly from grounding shell 104, is inserted between cable dielectric 112 and outer conductor 113. Therefore, outer conductor 113 and outer cladding 114 are clamped together by clamp 107 which was fitted on coaxial cable.

Since grounding shell 104 is fixed to insulating housing 103, coaxial connector 100 is mechanically connected to coaxial cable. Also, central contact 101 and grounding shell 104 are electrically connected to central conductor 111 and outer conductor 114, respectively.

When a coaxial cable connected to coaxial connector 100 above, is used in environments where wide temperature variations are encountered, central conductor 111 and cable dielectric 112 typically expand or contract relative to outer cladding 114. This movement variation is due to the fact that central conductor 111, cable dielectric 112, outer conductor 113 and outer cladding 114 have different thermal expansion coefficients.

When the expansion or contraction occurs, since outer conductor 113 and outer cladding 114 are fixed to insulating housing 103 through grounding shell 104, central contact 101, which is fixed to central conductor 111, is likely to be pulled out of insulating housing 103. A protrusion 102*a* is located at an intermediate portion of the central contact 101. Protrusion 102*a* prevents rearward movement of central contact 101 by engaging a locking stepped portion 101*a* protrusively provided in contact receiving hole 102. This is to prevent central conductor 111 from being pulled out of insulating housing 103 even if contraction of central conductor 111 occurs.

Conventional coaxial connector, 100 protrusion 101*a* is in central contact 101. Contact receiving hole 102 is provided with stepped portion 102*a* for engaging protrusion 101*a*. Stepped portion 102*a* is formed by cutting a U-groove 109 (see FIG. 10) lengthwise into the interior surface of contact receiving hole 102 at front end face of insulating housing 103 after it is removed from a molding die.

This structure may, due to thermal expansion or contraction, allow central contact 101 to tilt and partly enter into U-groove 109 of contact receiving hole 102. If control contact 101 is tilted, plug pin 120 will not correctly make resilient contact with contact piece 108 once inserted into contact receiving hole 102. Also, plug pin 120 must be inserted with greater force causes plastic deformation of contact piece 108.

Further, since U-groove 109 creates a detrimental air gap at an asymmetrical position about central contact 101, distortion will occur which will not match characteristic impedance of coaxial cable, this distortion will degrade high-frequency signal transmission characteristic.

Moreover, it is necessary to insert central contact 101 into contact receiving hole 102 while bringing protrusion 101*a* into engagement with stepped portion 102*a*, this impairs efficiency of assembling.

Also, since central contact 101 is inserted into contact receiving hole 102 until protrusion 101*a* goes beyond stepped portion 102*a*, they are always separated by a slight gap $\delta$ as illustrated in FIG. 9. Inevitably, after assembly, central contact 101 moves as central conductor 111 contracts.

Thus, there is still a need in art to devise a coaxially connector that will hold central contact in place regardless of thermal conditions and expansion and contraction caused therefrom.

OBJECT AND SUMMARY OF THE INVENTION

It is an object of the present invention to provide a coaxial connector that, even if thermally shocked, securely holds the central contact in place within the insulating housing and prevents breakage of the central contact.

Another object of the present invention is to provide a coaxial connector wherein, even if thermally shocked, securely retains and prevents degradation of the high-frequency transmission characteristic of the coaxial cable.

Another object of the present invention is to provide a coaxial connector that can be assembled with high efficiency.

It is the foregoing and various of drawbacks of the prior art which the present invention seeks to overcome by providing a coaxial connector that includes a central connector having a forward portion where a contact portion makes electrical contact with a central terminal of the mating connector. The central connector also has a rearward portion where a conductor connecting portion is crimped into contact with a central conductor of a coaxial cable. An insulating housing is bored lengthwise through a contact receiving hole to receive the central contact in place, and also, a grounding shell is mounted over the insulating housing and has a shell connecting portion extending from a rear end of the insulating housing. The grounding shell is crimped into contact with an outer conductor of the coaxial cable. Additionally, a marginal portion of the insulating housing around the conductor connecting portion, is thermally fusion welded to fixedly secure the central contact to the insulating housing when the terminal of the central conductor is brought into contact by crimping from the outside.

The terminal of the central conductor is crimped to the marginal portion of the conductor connecting portion from the outside of the marginal portion. Thus, the crimping action makes the surface of the marginal portion uneven and the thermally fused material of the insulating housing adheres to the uneven-surfaced marginal portion of the conductor connection portion. The adhering of the fused material firmly fixs the insulating housing and the central contact to each other.

Accordingly, the central contact will not be displaced in the insulating housing by the expansion or contraction of the central conductor when the coaxial cable undergoes thermal shock.

According to another aspect of the present invention, the conductor connecting portion is a crimp barrel of U-shaped cross section in a plane perpendicular to the lengthwise direction of said insulating housing and at least one groove is cut in the outer surface of said crimp barrel.

The groove in the outer surface of the crimp barrel ensures its deformation in the direction of extension of the groove by crimping—this enables the central conductor to be crimped into contact with the insulating housing with great strength.

Since the groove extends in a direction perpendicular to the lengthwise direction of the contact receiving hole, the thermally fused material of the insulating housing fills in the groove, by which the central contact is fixed more firmly.

According to still another aspect of the present invention, the shell connecting portion has engaging pieces which are bent into a cable dielectric surrounding the central conductor of the coaxial cable. This engages the shell connecting portion to the cable dielectric. Also, the outer conductor covering the shell connecting portion engages with the cable dielectric and the outer cladding of the coaxial cable rearward of the outer conductor. The outer conductor and the cable dielectric are crimped from the outside by a clamp to hold the cable dielectric as a unitary structure with the outer cladding through the shell connecting portion, the outer conductor and the clamp.

By the engagement of the engaging pieces of the shell connecting portion with the cable dielectric, the cable dielectric is fixed to the grounding shell attached to the insulating housing. Accordingly, the expansion or contraction of the cable dielectric by thermal shock is prevented by the fixed grounding shell; that is, the central conductor is free from the influence of the expansion or contraction of the cable dielectric—this further ensures preventing the displacement of the central contact.

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

BRIEF DESCRIPTION OF THE DRAWINGS

FIG. 5(*b*) is a front view of the grounding shell of FIG. 4.

FIG. 6(*b*) is the side view of the central contact of the present invention.

DETAILED DESCRIPTION OF THE PREFERRED EMBODIMENTS

Figure 1:
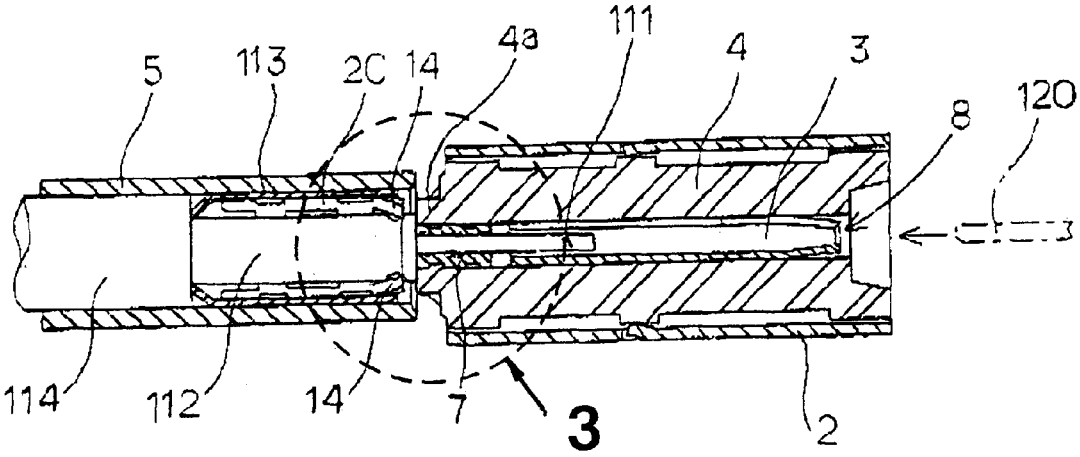
FIG. 1 is a cross sectional view of a coaxial connector according to an embodiment of the present invention.

Referring now to FIGS. 1–7(*e*), a coaxial connector includes a central contact 3, an insulating housing 4, an grounding shell 2 and a clamp 5.

Central contact 3, a cylindrical slim member, (as later illustrated in FIG. 6,) is formed by stamping a conductive thin metal sheet of phosphor bronze or other specially suitable material. The central contact 3 has a forward end portion slotted to form a pair of leaf-spring-like contact pieces 6 enabling resilient contact with both sides of plug pin 120. Plug pin 120 is inserted into a contact receiving hole 8 from the front side to establish electrical connections with contact pieces 6.

Figure 6A:
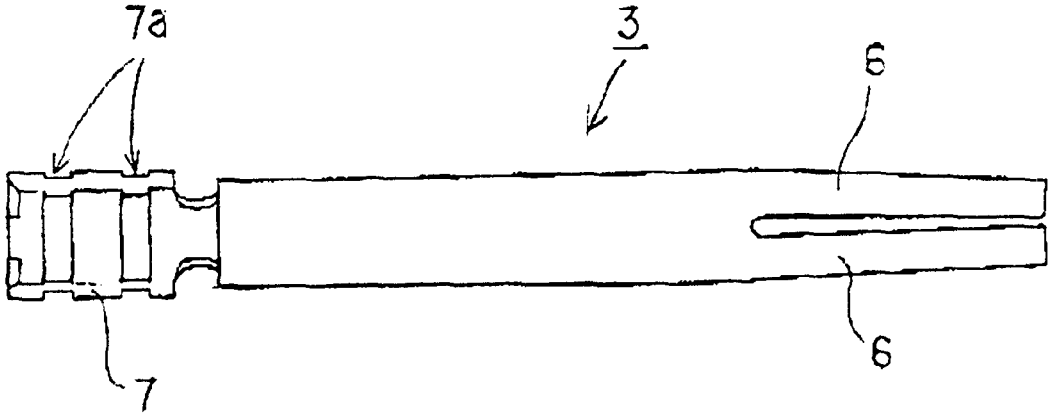
FIG. 6(*a*) is a plan view of the central contact of the present invention.
Figure 6B:
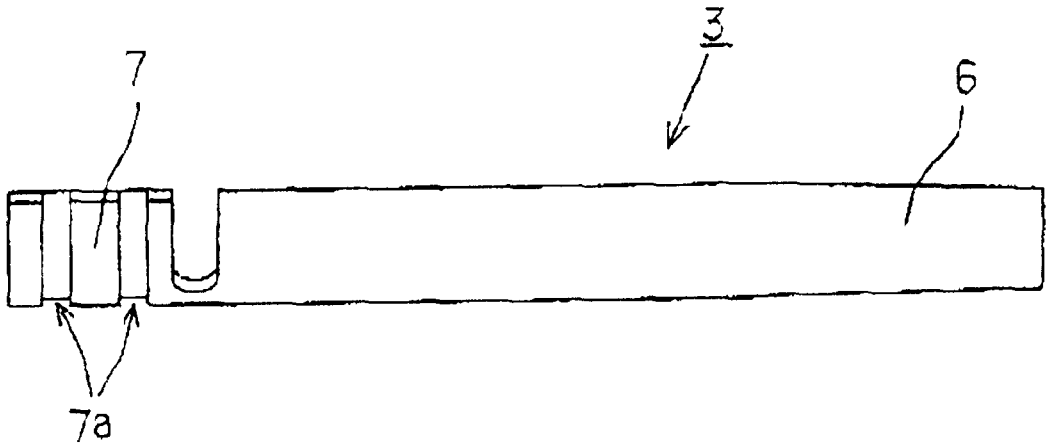
Figure 7A:
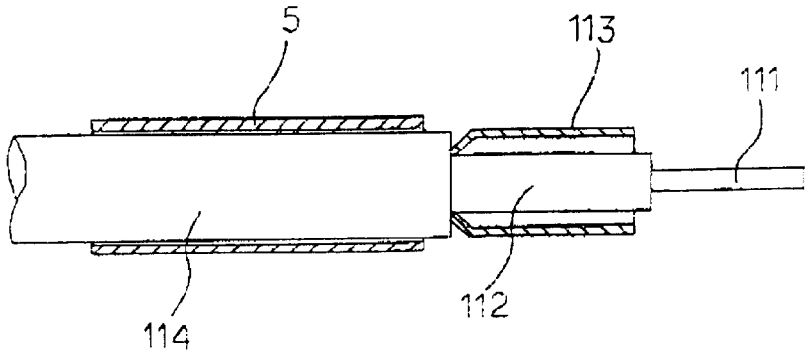
FIGS. 7(*a*) through 7(*e*) illustrate the assembly steps involved in connecting a coaxial cable to the coaxial connector.
Figure 7B:
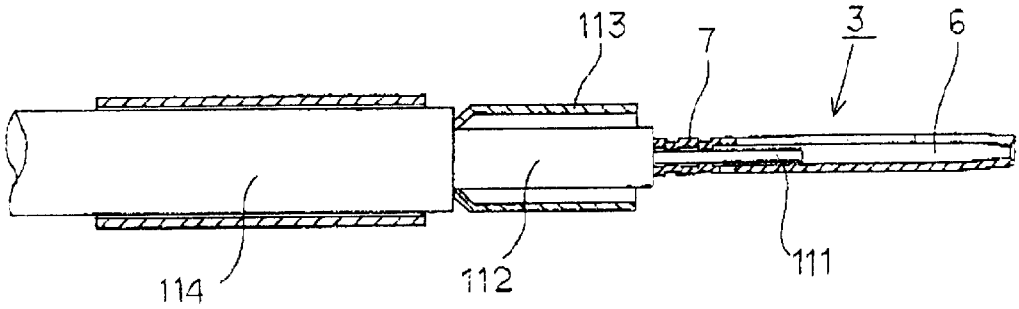
Figure 7C:
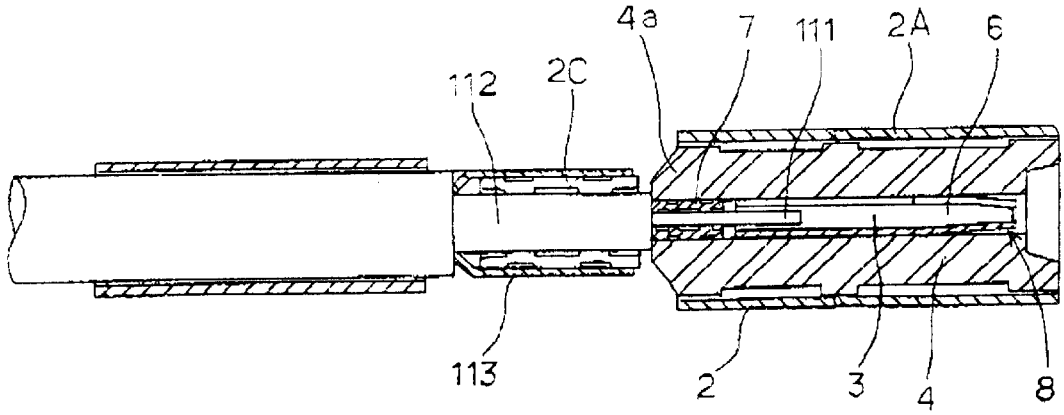
Figure 7D:
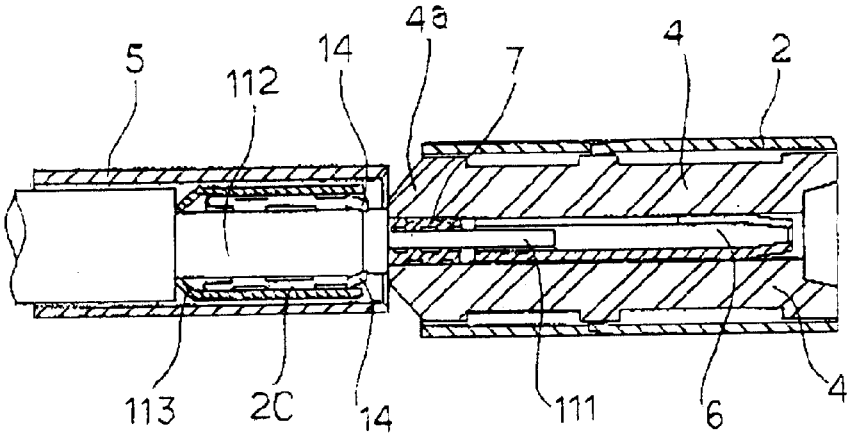
Figure 7E:
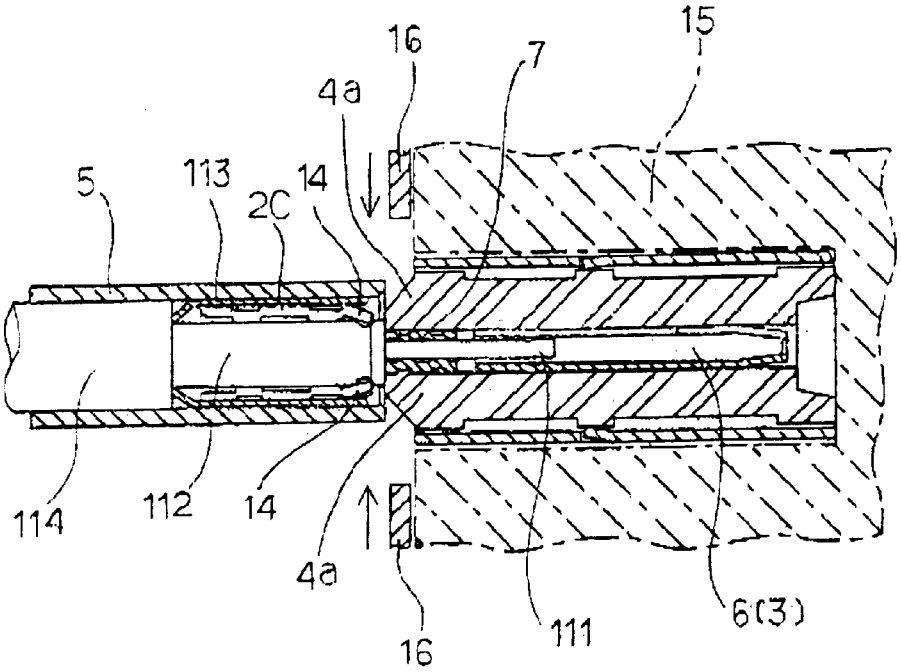
Figure 8:
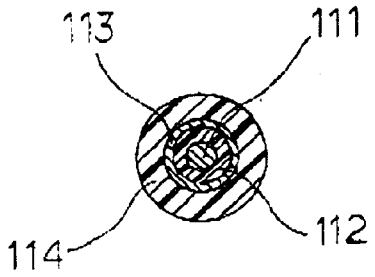
FIG. 8 (Prior Art)
FIG. 8 is a cross-sectional view of the conventional coaxial cable.
Figure 9:
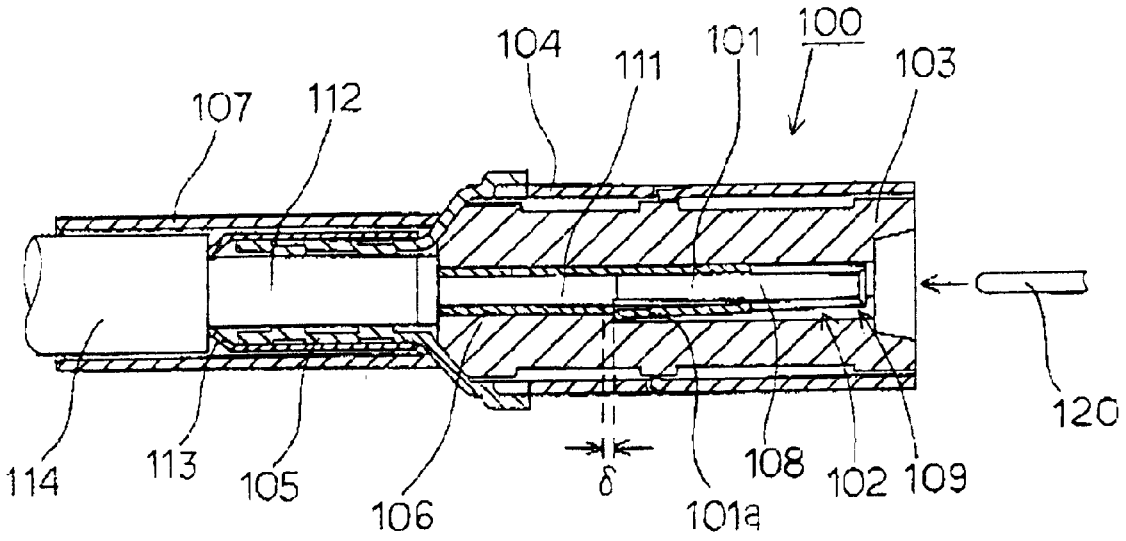
FIG. 9 (Prior Art)
FIG. 9 is a cross sectional view illustrating the conventional connection of a coaxial cable to a conventional coaxial connector and FIG. 10 is an exploded cross sectional view depicting the convetnional coaxial connector and the coaxial cable.
Figure 10:
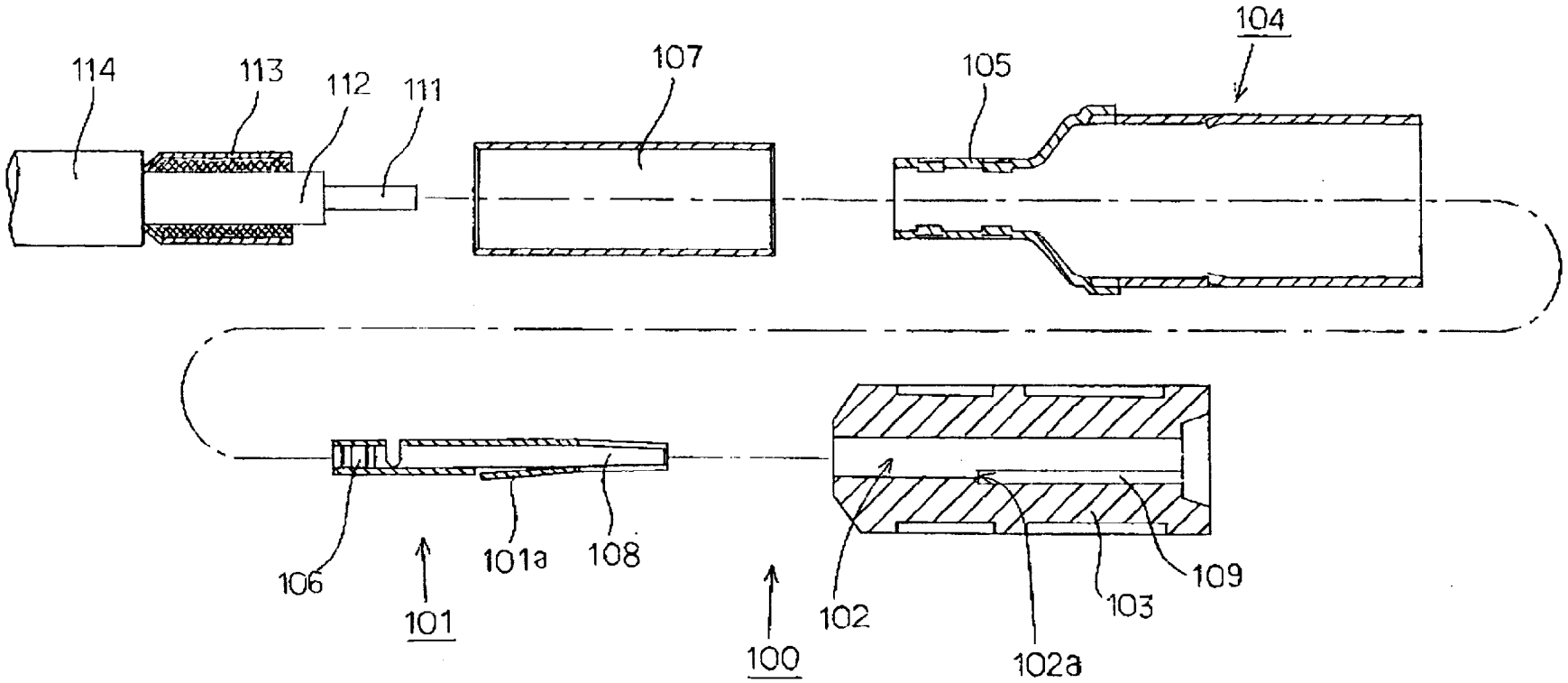
FIG. 10 (Prior Art)

Rear end portion of the central contact 3 is integrally formed with an open-topped crimp barrel 7 that has a U-shaped cross section in a plane perpendicular to the lengthwise direction of the central contact 3 (see FIG. 6). Crimp barrel 7 serves as a conductor connecting portion that is crimped into contact with the central conductor 111 of the coaxial cable once the central conductor 111 is inserted into the central contact 3 from rear end portion.

During assembly, crimp barrel 7 is crimped by pressing down a predetermined crimping jig (not illustrated) onto central conductor 111. There are two grooves 7*a* cut into the exterior surface of the U-shaped barrel 7 to provide maximum strength after crimping. During the crimping operation, the crimp barrel 7 is deformed in the direction of the downward movement of the crimping jig which is guided by the grooves 7*a*. This guidance prevents distortion of the crimp barrel 7 in the lengthwise direction of the central contact 3 and ensures the deformation of the barrel 7 will be in conformity to the inner bottom of the crimping jig which maximizes the crimping strength.

The insulating housing 4 is a cylindrical molding of PPS (polyphenylene sulfide) or similar insulating synthetic resin.

A contact receiving hole 8 will receive central contact 3 pressed into from the rear end. Contact receiving hole 8 is formed by boring through insulating housing 4 along the center axis. The contact receiving hole 8 has an inside diameter such that at least the interior surface of the rear end portion of the hole 8 contacts the crimp barrel 7.

The cylindrical surface of insulating housing 4 includes two positioning protrusions 9 at a rear end. FIG. 7(*c*), the rear end portion of the insulating housing 4 includes a fusion weld portion 4*a* whose peripheral surface is a rearwardly slanting conical surface.

Figure 4:
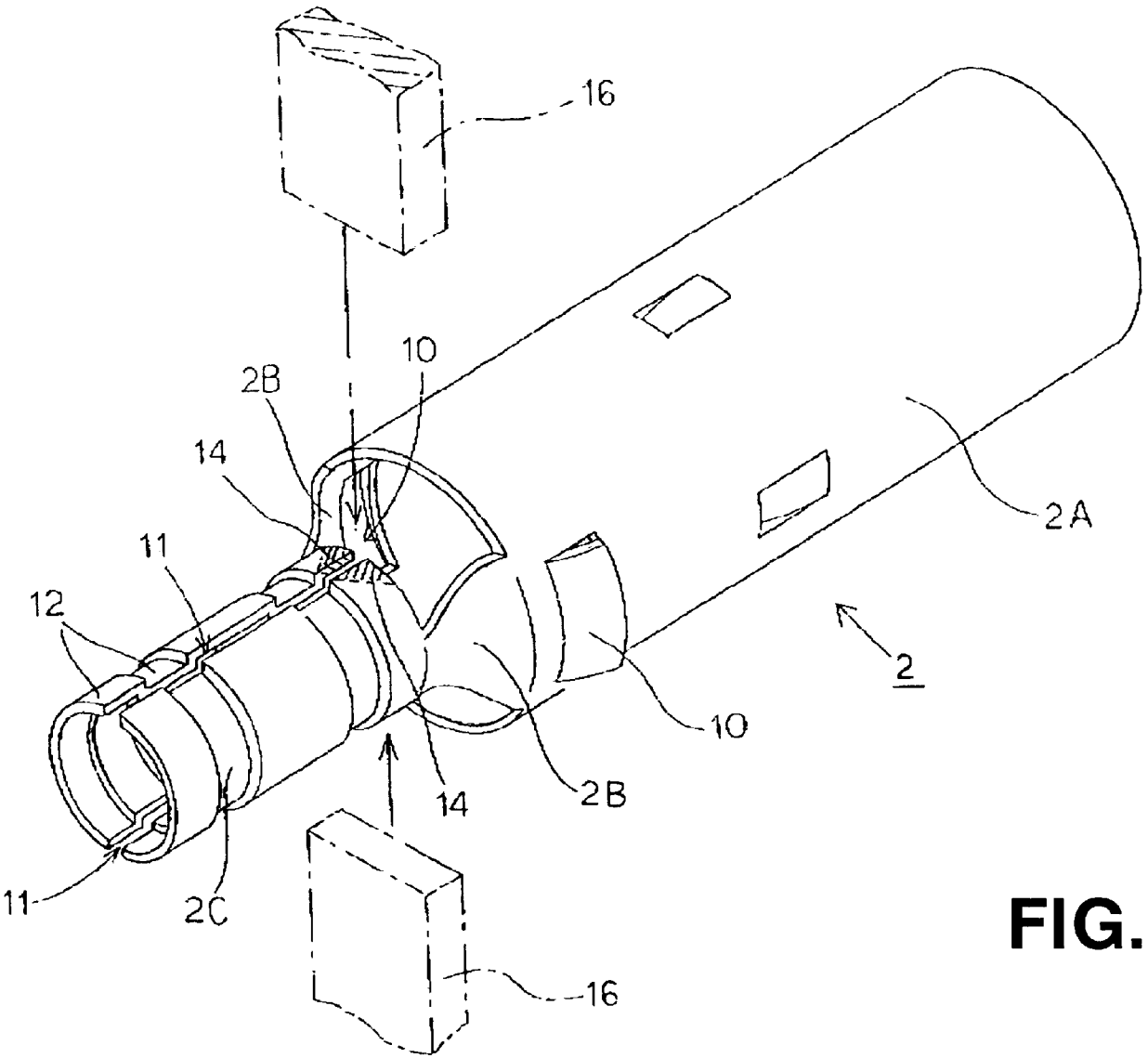
FIG. 4 is a perspective view of the grounding shell of the present invention.
Figure 5A:
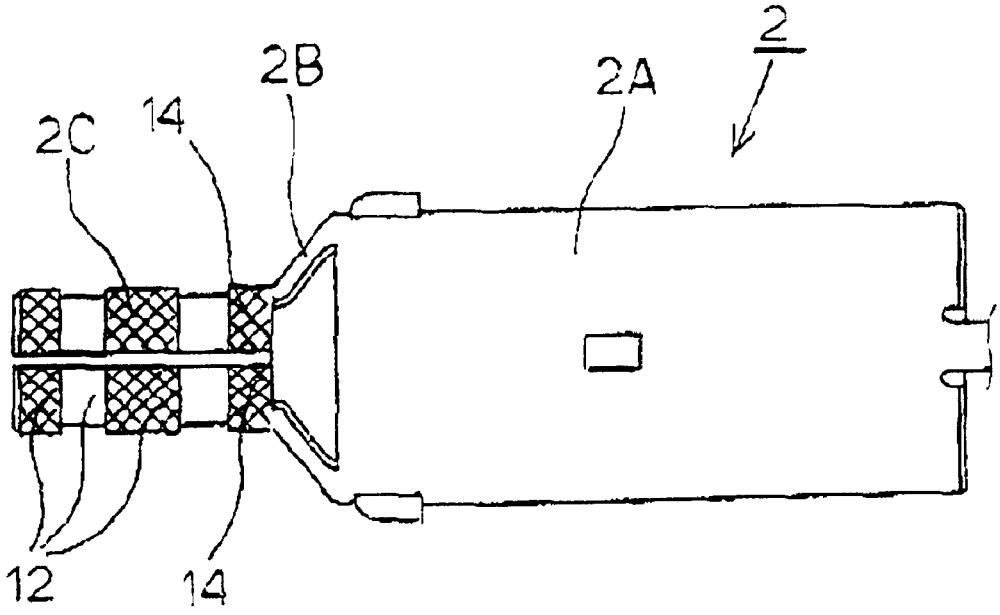
FIG. 5(*a*) is a plan view of the grounding shell of FIG. 4.
Figure 5B:
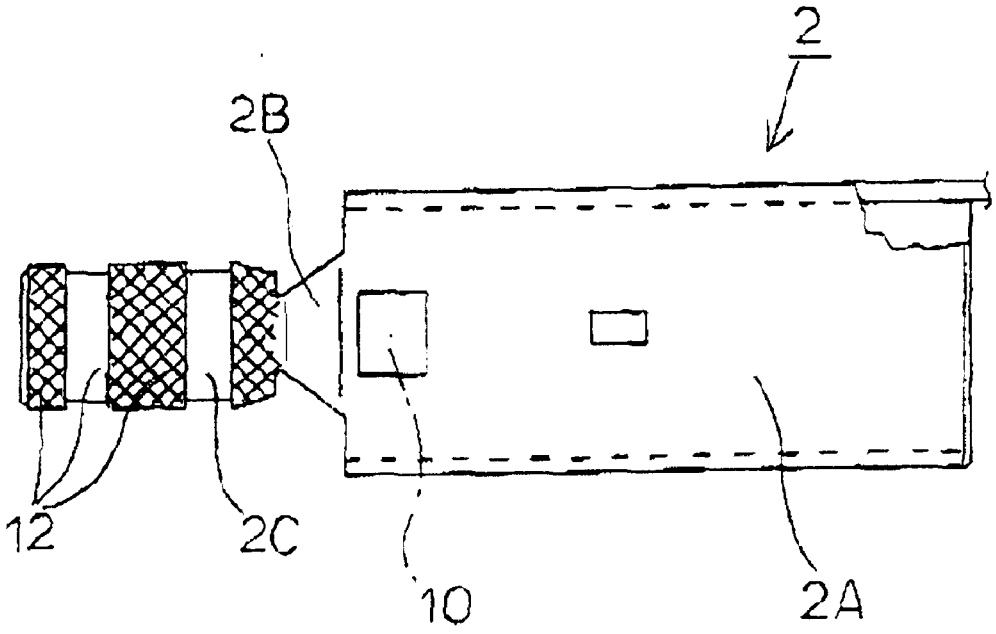

As illustrated in FIG. 4, the grounding shell 2 includes a cylindrical cover body 2A, covering the cylindrical surface of the insulating housing 4, and a cylindrical shell connecting portion 2C, formed integrally therewith through a pair of coupling pieces 2B. Grounding shell 2 is formed by stamping a conductive thin metal sheet of phosphor bronze or other specially suitable material. A conductive thin metal sheet of phosphor bronze or other specially suitable material can also be used to form central contact 3.

Cover body 2A, having a large diameter, and the shell connecting portion 2C, having a small diameter, are coupled together using coupling pieces 2B. Coupling pieces 2B are inclined rearwardly toward the center axis of the grounding shell 2 so that they abut against the rear end of the insulating housing 4. Since the coupling pieces are inserted into the cover body 2A from front, this limits further rearward insertion into the housing 4. The cover body 2A also includes near its rear end, two formed engaging windows 10 which are formatted by cutting the peripheral surface of the body 2A in a U shape at two places. Once abutted against the coupling piece 2B, the insulating housing 4 is positioned relative to the cover body 2A so the positioning protrusions 9 of the insulating housing 4 are engaged with the windows 10 of the cover body 2A. This positioning prevents the insulating housing 4 from slipping out of the cover body 2A. With the insulating housing 4 thus positioned, the fusion weld portion 4*a* is exposed between the pair of coupling pieces 2B at the rear of the cover body 2A (see FIG. 7(*c*)).

The shell connecting portion 2C includes of a pair of semi-cylindrical members split by upper and lower slits 11, and each of the semi-cylindrical members extend rearwardly from one of the coupling pieces 2B. The slits 11 enable the shell connecting portion 2C to expand and contract in the radial direction. This allows for ease in inserting the shell connecting portion 2C between the cable dielectric 112 and outer conductor 113 of the coaxial cable and also allows for deformation when crimped together.

The corner portions of the front ends of the pair of semi-cylindrical members adjacent the slits 11 form inwardly bendable engaging pieces 14 as illustrated by the broken lines in FIG. 4. When the shell connecting portion 2C is mounted onto the cable dielectric 112, the engaging pieces 14 are inwardly bent to engage the peripheral surface of the cable dielectric 112. They act to limit the relative expansion and contraction of the cable dielectric 112 due to thermal distortion.

The shell connecting portion 2C includes ring-like projections and depressions 12. Ring-like projections and depressions 12 extend across the peripheral surfaceand are formed circumferentially. The precessions and depressions prevent the cable dielectric 112 and the outer conductor 113 from being axially moved after the shell connecting portion 2C is crimped together with them.

The clamp 5 is a cylindrical member made of a suitable material such as metal and has an inside diameter size to permit loose insertion of the coaxial cable. The clamp is formed from a thin cylinder which allows for easy deformation when crimped.

Prior to the assembling, the outer cladding 113 and the cable dielectric 112 of the coaxial cable are peeled off at one end to expose the central conductor 111. Below the exposed central conductor 111 just the outer cladding 114 and a portion of the cable dielectric 112 are also peeled off, this will expose the outer conductor 113 outside of the cable dielectric 112, as shown. Either before or after the stripping of the coaxial cable, the coaxial cable is inserted through clamp 5. (See FIG. 7(*a*)).

Next, the forwardly projecting central conductor 111 is inserted into the central contact 3 and then crimped into electrical contact therewith by crimping the crimp barrel 7. Impedance distortion is not readily developed If central conductor 111 is inserted into the central contact 3 until the tip end reaches the base ends of the contact pieces 6, forward of the crimp barrel 7. The lack of impedance distortion is desirable in terms of the high-frequency transmission characteristic. By crimping the crimp barrel 7, the central contact 3 and the central conductor 111 are electrically connected and mechanically fixed to each other.

Next, the insulating housing 4 is inserted into the cover body 2A from the front and secured to the grounding shell 2 when the positioning protrusions 9 engage with the engaging windows 10 (see FIGS. 2 & 4) concurrently the central contact 3 is inserted into the contact receiving hole 8 of the insulating housing 4 with the grounding shell 2 mounted thereon. Simultaneous with the insertion of the central contact 3 into the insulating housing 4, the shell connecting portion 2C of the grounding shell 2 is inserted between cable dielectric 112 and outer conductor 113. Central contact 3 is inserted in its entirety into the contact receiving hole 8 until the contact pieces 6 make resilient contact with plug pin 120 inserted into the contact receiving hole 8 from the opposite side of the central contact 103.

Now, the engaging pieces 14 are bent inwardly engage with the surface of the cable dielectric 112 as depicted in FIG. 7(*d*). As a result, the cable dielectric 112 is fixed to the insulating housing 4 through the grounding shell 2. Grounding shell 2 is fixed to the insulating housing 4. After this, clamp 5, with the coaxial cable inserted, is moved to the forward end of the outer conductor 113 so the shell connecting portion 2C is interposed therebetween. Then the forward portion of the outer conductor 113 and the outer cladding 114 at the rear thereof are crimped. Thus, the outer cladding 114, the outer conductor 113, the shell connecting portion 2C and the cable dielectric 112 are crimped into a one-piece structure.

Illustrated in FIG. 7(*e*), the coaxial connector is connected to the coaxial cable as above, and is positioned in a holder 15 with the coupling portion and shell connecting portion 2C exposed. Heaters 16 are pressed against the fusion weld portion 4*a* from above and below to fuse the fusion weld portion 4*a*. In the grounding shell 2 there are gaps between the upper marginal edges of the coupling pieces 2B and between their lower marginal edges (see FIG. 4). By pressing the heaters 16 against the exposed areas of the fusion weld portions 4*a*, they may be fused only around the crimp barrel 7. The fused materials of the fusion weld portion 4*a* flows around the crimp barrel 7, which was deformed by crimping, and becomes hardened by natural cooling. This fixes the crimp barrel 7 and the insulating housing 4 to each other.

In a preferred embodiment, the insulating housing 4 is made of PPS, the fusion weld portion 4*a* is heated by the heaters 16 in the temperature range from 250° C. to 270° C.

Figure 2:
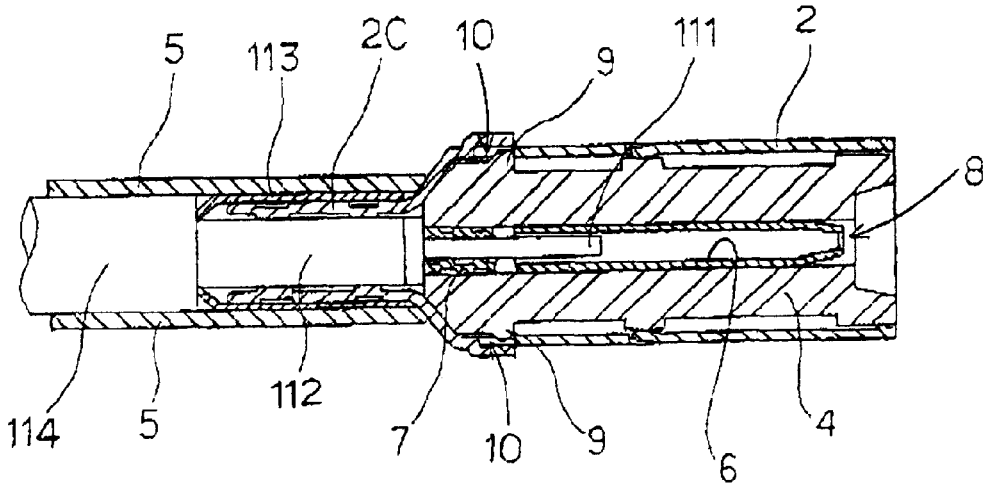
FIG. 2 is a transverse cross-setional view of the present invention.
Figure 3:
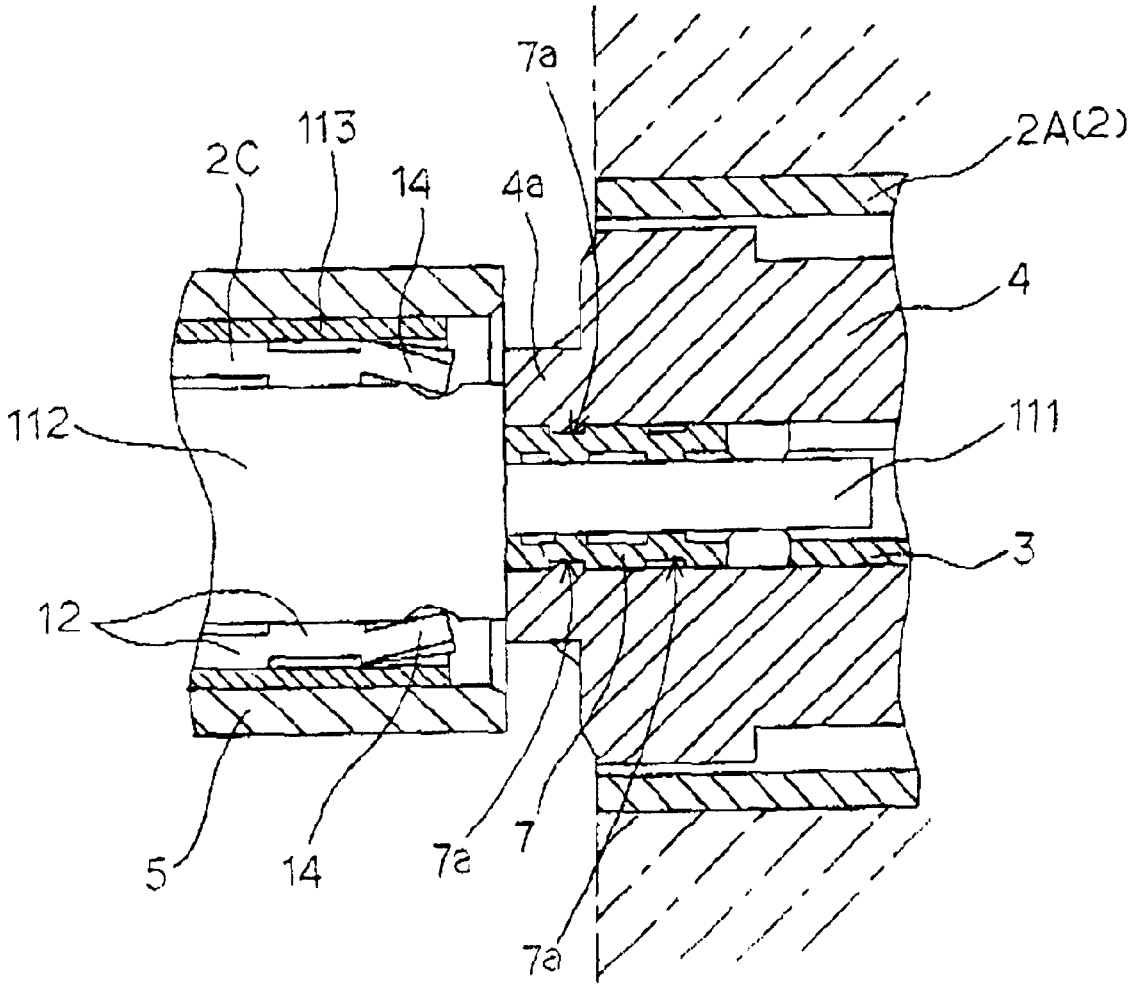
FIG. 3 is an enlarged detail of circle 3 from FIG. 1.

Once the coaxial connector 1 is connected to the coaxial cable, the outer conductor 113 is connected to the grounding shell 2 so that the central conductor 111 and the central contact 3, now connected to each other, are surrounded by an equal dielectric capacitance as illustrated in FIGS. 1 and 2. Therefore, as a particular benefit of this invention it is possible to establish electrical connections between the coaxial connector and the plug pin 120 of the mating connector inserted into the contact receiving hole 8 while matching them with the characteristic impedance of the coaxial cable.

As a particular benefit of the present invention the insulating housing 4 and the central contact 3 are fixed first by crimping the crimp barrel 7 and then by fusion welding the fusion weld portion 4*a* which is around the crimp barrel 7, the insulating housing 4 and the central contact 3 will not move even if the central conductor 111 expands or contract due to thermal shock of the coaxial cable.

Moreover, since the engaging pieces 14 of the grounding shell 2 are engaged with the surface of the cable dielectric 112, the cable dielectric 112 is also fixed to the insulating housing 4 through the grounding shell 2, and hence it will not expand or contract even if it undergoes thermal shock.

While the above embodiment has been described to hold the outer cladding 114, the outer conductor 113 and the shell connecting portion 2C in unitary relation by use of the clamp 5, it is possible to dispense with the clamp 5 when the shell connecting portion 2C is formed over the outer cladding 114 and the outer conductor 113 and crimped to form a unitary structure with them.

In another embodiment, the engaging pieces 14 of the grounding shell 2 need not be provided. The thermal fusion welding of the insulating housing 4 around the crimp barrel maybe enough to solve the problem of thermal shock.

As described above, according to the present invention, it is possible to prevent the central contact from displacement relative to the insulating housing when the coaxial cable undergoes thermal shock, without the necessity for forming lugs for preventing the central contact from being pulled out of the contact receiving hole or forming an engaging stepped portion in the contact receiving hole.

Accordingly, the contact receiving hole has no extra groove no extra groove, and hence holds the central contact in position, enabling it to make resilient contact with the plug pin inserted into the contact receiving hole. As a result, the contact portion of the central contact will not be broken by forced insertion of the plug pin.

Further, since the contact receiving hole has no engaging stepped portion or groove, the die structure is simplified, allowing ease in molding the insulating housing. Moreover, since the central contact has no groove, the capacitance between the central contact and the grounding shell remains unchanged, and hence the high-frequency transmission characteristic will not degrade.

Further, since the directionality about the center axis of the insulating housing is not needed for adjusting the positions of the engaging piece with the position of the stepped portion, the central contact can be easily inserted into the contact receiving hole.

According to another aspect of the present invention, the formation of U-shaped grooves in the outer surface of the crimp barrel ensures fixing thereto the central conductor with efficient crimping strength. Since after assembly, the grooves are filled with fused material of the insulating housing, the central contact can be fixed more firmly even if the central conductor undergoes thermal shock.

Further, according to other another aspect of the invention, since the shell connecting portion engages the cable dielectric, the expansion or contraction of the cable dielectric is limited by the fixed grounding shell, and the central conductor is free from the influence of the expansion or contraction of the cable dielectrica and this further ensures the central contact from being displaced.

Thus, while there have been shown, described, and pointed out fundamental novel feature of the invention as applied to a prefered embodiment thereof, it will be understood that various omissions, substitutions, and changes in the form and detail of the devises illustrated, and in there operation, maybe made by those skilled in the art without departing from the spirit and scope of the invention. For example, it is expressly intended that all combinations of those elements and/or steps which preform substantially the same function, in substantially the same way, to achieve the same results or within the scope of the invention. Substitution of elements from one described environment to another are also fully intended and contemplated. It is also to be understood that the drawings are not necessarily drawn to scale but that they are merely conceptional in nature with the intention, therefore, to be limited only as indicated by the scope of the claims appended hereto.

What is claimed is:

1. A coaxial connector comprising:

a central contact having a forward portion and a rear end portion; said forward portion being electrically connectable to a plug pin of an external mating connector during use; said central contact including a crimp portion; said crimp portion disposed at said rear end portion of said central contact, said rear-end portion formed to receive and electrically connect to a central conductor of a coaxial cable during said use; said crimp portion of said central contact being mechanically compressible to contact and reliably secure said central conductor during said use;

an insulating housing defining a first cavity:

said first cavity forming a contact receiving hole for receiving said central contact: said insulating housing including at least a fusion weld portion alignable with said crimp portion of said central contact during an assembly;

said fusion weld portion being thermally fusable to said crimp portion to fixedly secure said insulating housing to said central contact during said use; and a grounding shell defining a cavity and having a back end;

said insulating housing being disposed within said grounding shell cavity;

said grounding shell including:

at least a first shell connecting portion integral to said back end of said grounding shell and being mechanically compressible to contact an outer conductor of said coaxial cable whereby said crimp portion, said fusion weld portion, and shell connecting portion provide reliable electrical contact between said central conductor and said mating connector.

2. A coaxial connector, according to claim 1, wherein said crimp portion further comprises:

at least a first U-shaped cross-section taken along a plane perpendicular to an axial direction of said insulating housing; and at least a first groove in an outer surface of said crimp portion proximate to said U-shaped cross-section.

3. A coaxial connector, according to claim 1, wherein said forward portion of said central contact further comprises:

a plurality of contact pieces being electrically connectible to said plug pin, said contact pieces being deformable.

4. A coaxial connector, according to claim 1, wherein said grounding shell further comprises: at least one engaging piece;

said engaging piece being engagable to a cable dielectric of said coaxial cable when said shell connecting portion is compressed to contact said outer conductor.

5. A coaxial connector, according to claim 1, wherein said coaxial connector further comprises:

a plurality of engaging windows having a U shape and disposed on a surface of said grounding shell; and a plurality of positioning protrusions disposed on the insulating housing, said engaging windows being engagable with said positioning protrusions whereby said insulating housing is reliably engaged within said grounding shell.

6. A coaxial connector, according to claim 1, wherein said coaxial connector further comprises:

a plurality of engagable pieces disposed on said grounding shell, said engagable pieces being engagable to a cable dielectric of said coaxial cable, whereby said grounding shell is reliably engaged with said cable dielectric.

7. A coaxial connector comprising:

a central contact having a forward portion and a rear end portion; said forward portion being electrically connectable to a plug pin of an external mating connector during use; said central contact including a crimp portion; said crimp portion disposed at said rear end portion of said central contact, said rear-end portion formed to receive and electrically connect to a central conductor of a coaxial cable during said use; said crimp portion of said central contact being mechanically compressible to contact and reliably secure said central conductor during said use; wherein said crimp portion further comprises:

at least a first U-shaped cross-section taken along a plane perpendicular to an axial direction of said insulating housing;

and at least a first groove in an outer surface of said crimp portion proximate to said U-shaped cross-section;

an insulating housing defining a first cavity:

said first cavity forming a contact receiving hole for receiving said central contact:

said insulating housing including at least a fusion weld portion alignable with said crimp portion of said central contact during an assembly;

said fusion weld portion being thermally fusable to said crimp portion to fixedly secure said insulating housing to said central contact during said use; and a grounding shell defining a cavity and having a back end;

said insulating housing being disposed within said grounding shell cavity;

said grounding shell including:

at least a first shell connecting portion integral to said back end of said grounding shell and being mechanically compressible to contact an outer conductor of said coaxial cable whereby said crimp portion, said fusion weld portion, and shell connecting portion provide reliable electrical contact between said central conductor and said mating connector.

8. A coaxial connector comprising:

a central contact having a forward portion and a rear end portion; said forward portion being electrically connectable to a plug pin of an external mating connector during use; said central contact including a crimp portion; wherein said forward portion of said central contact further comprises:

a plurality of contact pieces being electrically connectible to said plug pin, said contact pieces being deformable said crimp portion disposed at said rear end portion of said central contact, said rear-end portion formed to receive and electrically connect to a central conductor of a coaxial cable during said use;

said crimp portion of said central contact being mechanically compressible to contact and reliably secure said central conductor during said use; wherein said crimp portion further comprises:

at least a first U-shaped cross-section taken along a plane perpendicular to an axial direction of said insulating housing; and at least a first groove in an outer surface of said crimp portion proximate to said U-shaped cross-section;

an insulating housing defining a first cavity:

said first cavity forming a contact receiving hole for receiving said central contact:

said insulating housing including at least a fusion weld portion alignable with said crimp portion of said central contact during an assembly; said fusion weld portion being thermally fusable to said crimp portion to fixedly secure said insulating housing to said central contact during said use; and a grounding shell defining a cavity and having a back end;

said insulating housing being disposed within said grounding shell cavity;

said grounding shell including:

at least a first shell connecting portion integral to said back end of said grounding shell and being mechanically compressible to contact an outer conductor of said coaxial cable whereby said crimp portion, said fusion weld portion, and shell connecting portion provide reliable electrical contact between said central conductor and said mating connector.

9. A method for assembling a coaxial connector, comprising the steps:

(a) exposing a central conductor of a coaxial cable;

(b) inserting said central conductor into a central contact, said central contact includes a crimp portion disposed at a rear end portion of said central contact;

(c) crimping said crimp portion to electrically connect to said central conductor;

(d) engaging an insulating housing into a cavity formed in a grounding shell;

(e) inserting a shell connecting portion of said grounding shell between an insulated cable dielectric of said coaxial cable and an outer conductor of said coaxial cable;

(f) inserting said central contact into a cavity formed in said insulating housing; and (g) welding said insulating housing to said crimp portion of said central contact, whereby said central conductor, said central contact, said insulating housing and said grounding shell being integral to each other.

10. A coaxial connector comprising:

a central contact having a forward portion and a rear end portion;

said forward portion being electrically connectable to a plug pin of an external mating connector during use; said central contact including a crimp portion; said crimp portion disposed at said rear end portion of said central contact, said crimp portion forming an uneven surface, said rear-end portion formed to receive and electrically connect to a central conductor of a coaxial cable during said use; said uneven portion of said crimp portion of said central contact being mechanically compressible to contact and reliably secure said central conductor during said use;

an insulating housing defining a first cavity:

said first cavity forming a contact receiving hole for receiving said central contact:

said insulating housing including at least a fusion weld portion alignable with said crimp portion of said central contact during an assembly;

said fusion weld portion being thermally fusable to said uneven portion of said crimp portion to fixedly secure said insulating housing to said central contact during said use; and a grounding shell defining a cavity and having a back end;

said insulating housing being disposed within said grounding shell cavity;

said grounding shell including:

at least a first shell connecting portion integral to said back end of said grounding shell and being mechanically compressible to contact an outer conductor of said coaxial cable whereby said crimp portion, said fusion weld portion, and shell connecting portion provide reliable electrical contact between said central conductor and said mating connector.

11. A coaxial connector comprising:

a central connector; and having in a forward portion a contact portion which makes electrical contact with a central terminal of a mating connector during an assembly;

having in a rearward portion a conductor connecting portion which is crimped into contact with a central conductor of a coaxial cable during an assembly;

a cylindrical insulating housing having, an axial contact receiving hole for receiving said central contact during said assembly; and a grounding shell mounted over said insulating housing and having a shell connecting portion extending from a rear end of said insulating housing; said grounding shell being in crimped contact with an outer conductor of said coaxial cable after said assembly; a marginal portion of said insulating housing, being thermally fusable to proximate said conductor connecting portion, with the terminal of said central conductor brought into contact by crimping from the outside, is thermally fusion welded to fixedly secure said central contact to said insulating housing.

12. The coaxial connector according to claim 11, wherein:

said conductor connecting portion is a crimp barrel having a U-shaped cross section in a plane perpendicular to an axial direction of said insulating housing; and a groove cut in an outer surface of said crimp barrel.

13. The coaxial connector according to claim 11, wherein:

said shell connecting portion having engaging pieces being bent into a cable dielectric surrounding said central conductor of said coaxial cable for engagement therewith; and said outer conductor covering said shell connecting portion being engaged with said cable dielectric and said outer cladding of said coaxial cable rearward of said outer conductor, and being crimped from outside by a clamp to hold said cable dielectric as a unitary structure with said outer cladding through said shell connecting portion, said outer conductor and said clamp.

* * * * *